United States Patent [19]

Key

[11] Patent Number: 4,462,647

[45] Date of Patent: Jul. 31, 1984

[54] KNOCK-DOWN CUPBOARD

[76] Inventor: Gerald Key, P.O. Box 1377, Uxbridge, Ontario, Canada

[21] Appl. No.: 475,161

[22] Filed: Mar. 14, 1983

[51] Int. Cl.[3] ..... A47B 43/00; A47B 47/02

[52] U.S. Cl. ..... 312/257 SM; 312/108; 312/257 R; 312/263

[58] Field of Search ..... 312/257 R, 257 SM, 257 A, 312/263, 264, 265, 108, 100, 330 SM, 257 SK; 108/107; 220/4 F

[56] References Cited

U.S. PATENT DOCUMENTS

| | | | |
|---|---|---|---|
| 1,560,922 | 11/1925 | Wege | 312/257 R |
| 2,571,622 | 10/1951 | Schmidt | 312/263 |
| 2,727,800 | 12/1955 | Snider | 312/263 |
| 2,869,953 | 1/1959 | Miller et al. | 312/265 X |
| 3,337,983 | 8/1967 | Ebstein | 312/263 X |
| 3,393,031 | 7/1968 | Morrill | 312/257 R |
| 4,173,379 | 11/1979 | van der Heiden et al. | 312/257 SM X |
| 4,201,428 | 5/1980 | Johnson | 312/257 R |
| 4,232,920 | 11/1980 | Bukaitz | 312/257 SK X |
| 4,289,363 | 9/1981 | Andersson et al. | 312/257 R |
| 4,296,982 | 10/1981 | Kullander | 312/257 A X |

FOREIGN PATENT DOCUMENTS

| | | | |
|---|---|---|---|
| 635000 | 1/1962 | Canada | 312/257 R |
| 81107 | 10/1961 | France | 312/257 R |
| 843016 | 8/1960 | United Kingdom | 312/257 R |
| 869609 | 5/1961 | United Kingdom | 312/257 R |

*Primary Examiner*—Victor N. Sakran
*Assistant Examiner*—Thomas A. Rendos
*Attorney, Agent, or Firm*—Fetherstonhaugh & Co.

[57] ABSTRACT

A boltless sheet metal cabinet assembly having a top wall, a bottom wall, a back wall, and opposed side walls, a flange on the back longitudinal edge of each side wall, that forms a U-configuration, a flange on each of the side edges of said back wall that forms a U-configuration, the flanges on the back wall and the flanges of the side walls being adapted to interlock with each other, the front longitudinal edge of each side wall being formed with a channel, rigidifying top and bottom bars having stab connectors at each of their ends for entry into the channel of one of the side walls whereby to extend between the side walls and space them apart, the top wall having downwardly extending flanges, the flange along the front edge of the top wall adapted to snap over the lower portion of the rigidifying top bar, the flange along the back edge of the top wall having a U-configuration, the upper edge of the top wall having a flange that forms a U-configuration that is adapted to interlock with the flange on the back edge of the top wall, each of the back wall and side walls having an inwardly directed channel at their lower edges, the bottom wall having flanges along its back and side edges adapted to drop into said channels of the back and side walls, and the bottom wall having a flange at its front edge to embrace the bottom rigidifying bar.

2 Claims, 8 Drawing Figures

30
32
34
38
28
36
25
16
24
2b
2a
54
18
27
26
20

KNOCK-DOWN CUPBOARD

This invention relates to an assembly for a sheet metal cupboard or cabinet that can be assembled from a lay-flat, knock-down condition to an erected position without the use of bolts.

Assemblies for sheet metal cupboards and the like that can be erected from a knock-down to a set-up position are popular. The component parts of the assembly of the nature with which this invention is concerned are made from a relatively light guage sheet metal. The consumer buys the assembly in a cardboard container in the lay-flat condition, takes it home and assembles it. The assembly operation is, of necessity, simple because it must be something that can be handled by the ordinary householder, who is not a skilled fitter.

The use of these assemblies has, however, given rise to problems that are of long standing. In the past the assemblies must be secured in position by bolts. These bolts require screw drivers and, in some cases, wrenches for completion. Many householders do not have an appropriately sized screw driver or wrench. This is obviously an inconveniene. Many others find it difficult to manipulate nuts and bolts in the assembly of a simple cupboard. In many instances the assembly of these cupboards is attempted by persons of the lowest mechanical skill.

There is also the problem of providing sufficient nuts and bolts to do the job and the problem of nuts and bolts becoming lost. These are problems of stock keeping and of complaints made to retailers because of deficiencies of the shipment.

This invention overcomes all of these disadvantages that arise from the inclusion of nuts and bolts in the cupboard assembly. With this invention the component parts have been fashioned to interlock and maintain themselves in assembled position without the use of nuts and bolts. The general arrangement of the parts is similar to that of the prior art, but the parts have been designed such that they interact with each other to maintain the assembly rigid without the use of bolts and this is a very substantial advance in the art of providing simple knock-down cupboard assemblies.

A boltless cupboard or cabinet assembly according to this invention comprises a boltless sheet metal cupboard having a top wall, a bottom wall, a back wall, and opposed side walls, the back wall and the side walls being formed along their adjoining edges to telescope together in a direction longitudinally of their edges, a rigidifying top bar to extend between the side walls of their upper extremities, said top bar and said side walls being formed to telescope together, rigidifying bottom bar to extend between the side walls at their lower extremities, said bottom bar and said side walls being formed to telescope together, said top wall having a downwardly extending front flange adopted to overlie the front face of said top rigidifying bar and an inwardly projecting locking flange at the lower edge of said front flange adapted to engage the marginal area of the underside of said top rigidifying bars in use, said bottom wall having a downwardly extending front flange adpted to overlie the front face of said bottom rigidifying bar and an inwardly projecting locking flange at the lower edge of said front flange adapted to engage the marginal area of the underside of said bottom rigidifying bar in use, the side walls and back wall being formed along their adjoining edges to the bottom wall with a channel adapted to receive the adjoining edge of the bottom wall in nesting relation. The invention will be clearly understood after reference to the following detailed specification read in conjunction with the drawings. In the drawings:

Figures 2, 2A, 2B:
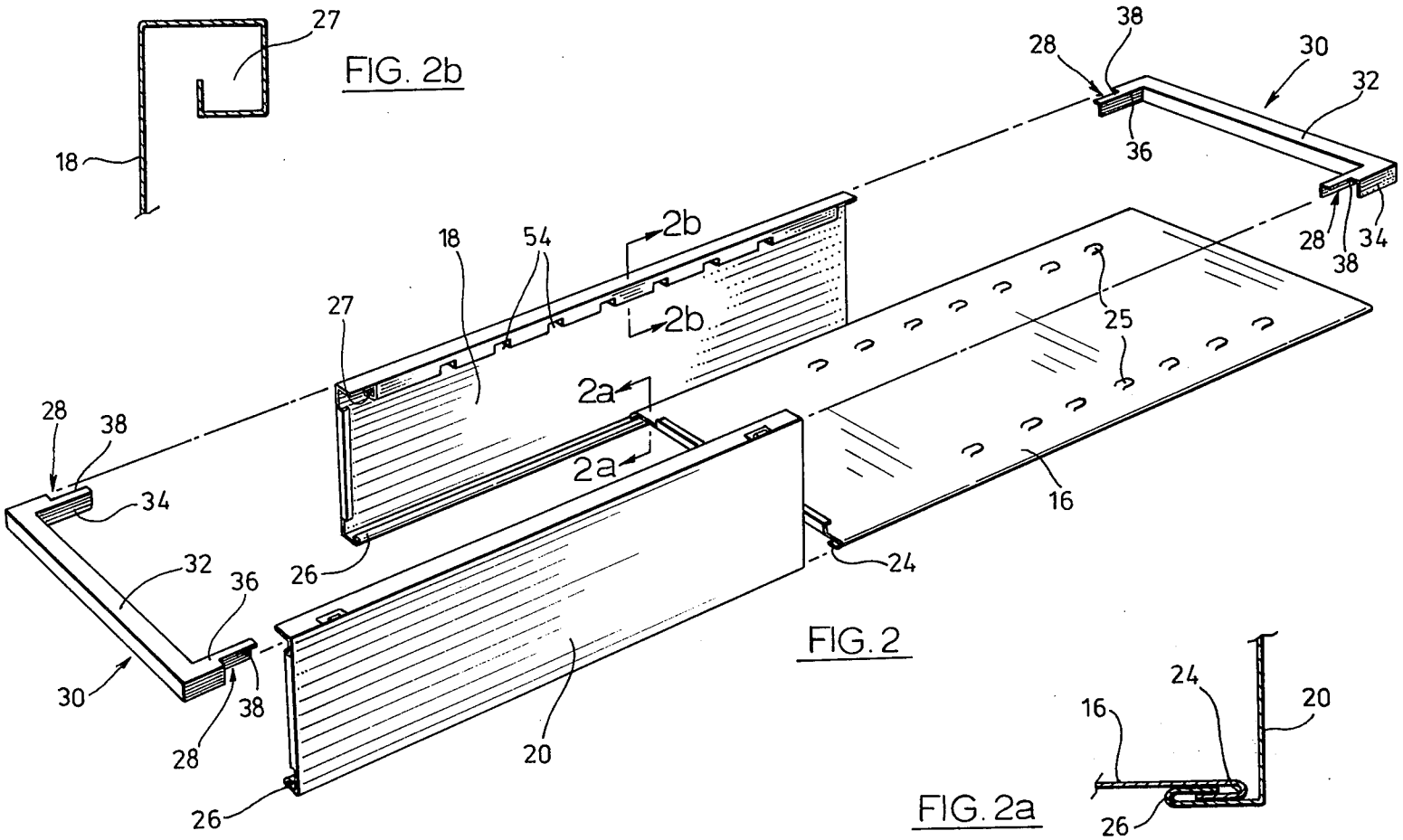
FIG. 2 is an illustration of the first steps in setting up the cupboard from the knock-down condition.
Figures 3, 4, 5, 6:
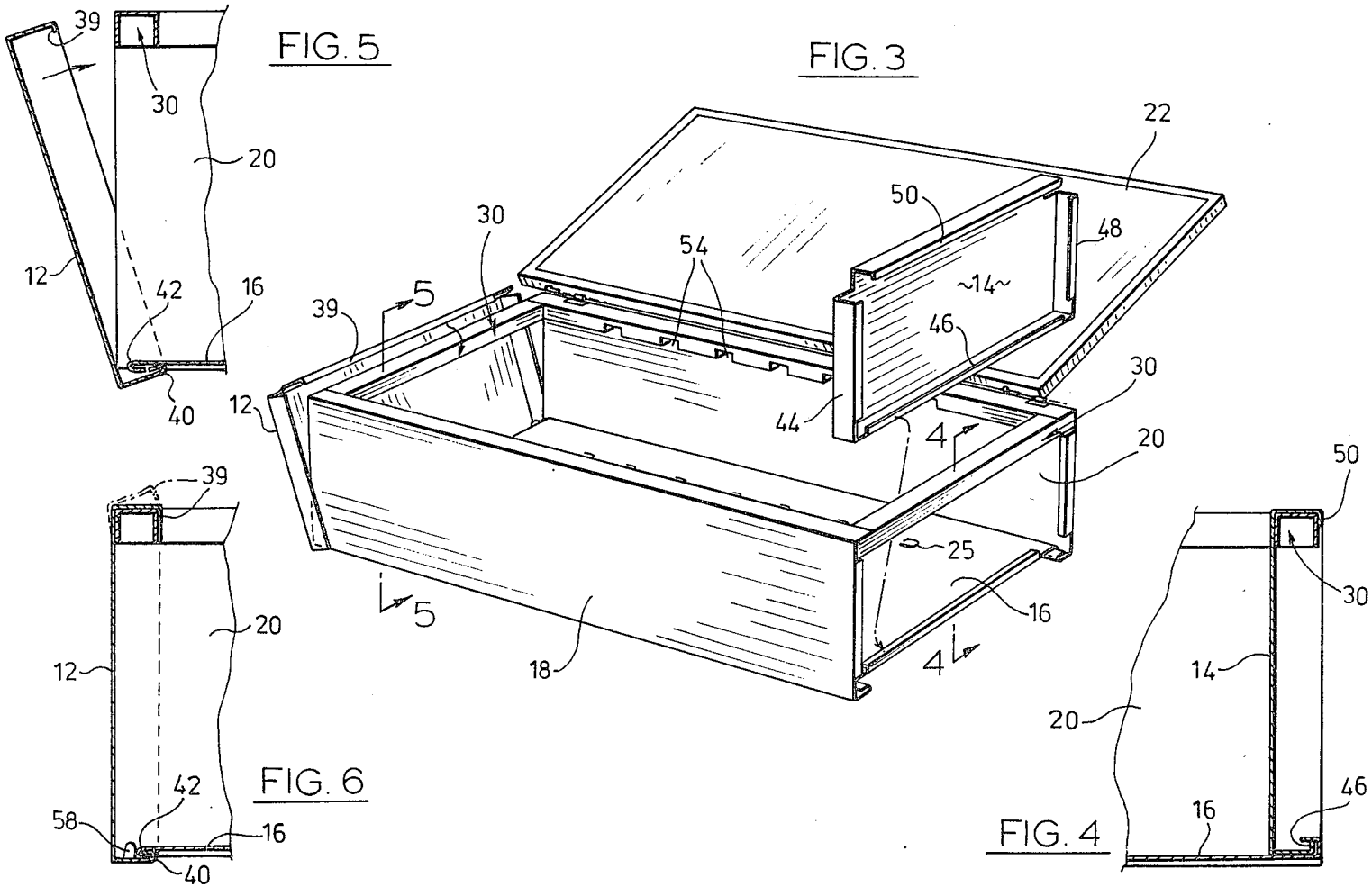

FIG. 2*a* is an illustration along the line 2*a*—*2a* of FIG. 2 showing the telescoping nature of the interconnection of the side walls and the back wall;

FIG. 2*b* is an illustration along the lines 2*b*–*2b* of FIG. 2 showing the channelled nature of the longitudinal edges of the side walls which telescopingly receives the stab connectors of the top and bottom rigidifying bars;

FIG. 3 illustrates the manner in which the flanged top wall and bottom wall are locked into position with the action of their locking flanges that lock over the under side of the rigidifying bars;

FIG. 4 is a view along the line 4—4 of FIG. 3 showing the manner in which the flanged bottom wall nests in the bottom walls and interlocks with the rigidifying bar;

FIG. 5 is an illustration along line 5—5 of FIG. 3 showing the manner of assembling the top wall; and FIG. 6 is an illusration similar to FIG. 5 but with the top wall in place and the lugs in the flange along the back edge of the top wall depressed from the plane of the flange to limit the sliding movement of the back wall with respect to the side walls.

In the drawings the numeral 10 generally refers to a cupboard constructed in accordance with the present invention. The cupboard has been assembled without the use of bolts of any kind. This is a very substantial advantage for a cupboard of this general class which must be manufactured for shipping and storage in a knock-down form wherein each of the walls and shelves are packed in stacked relation within a carboard container. It is practice to ship these items to retail merchants who sell them to consumers. The consumer takes delivery of the compact flat package and erects th cupboard himself.

It will be apparent that it is of importance with such articles that the component parts should be easy to assemble and preferably without the use of bolts because bolts tend to become misplaced. They also require tools for assembly. Many householders do not have a good selection of tools available and, in the case where a screwdriver is required, there is often a necessity to acquire a special screwdriver for the particular type of bolt supplied.

The cupboard illustrated has a top wall 12, a bottom wall 14, a back wall 16 and opposed side walls 18 and 20. A door 22 is hinged to a channel formation on an edge of side wall 20.

As noted above, the top wall, bottom wall, back walls and door are supplied in knock-down form. FIGS. 2 to 5 illustrate the manner of assembling these parts.

The back wall 16 is laid flat on a floor with the shelf hooks 25, to be referred later, facing upwardly. The side edges of the back wall each have a longitudinally extending hem which assumes a U-formation as at 24 in FIG. 2*a*. The back upright edges of the side walls 18 and 20 each have a flange that extends at right angles therefrom and that is also formed with a U-shaped hem as at 26. The U-shaped hems on the back wall and the side walls are adapted to interlock as the side walls are slid longitudinally of the back wall in right angled relationship as indicated in FIG. 2.

The front edges of each of the side walls is formed with a channel as at 27 (FIG. 2*b*) to accommodate the stab connectors 28 of the top and bottom rigidifying bars 30.

The rigidifying bars generally indicated by the numeral 30 comprise a U-shaped horizontal sheet metal channel 32 to which is welded a stab contact generally indicated by the numeral 28. Stab contact 28 has a U-shaped form at its inner portion with a bottom 32 and side walls 34 and 36. The U-shaped channel forms a channel that telescopes within the U-shaped channel 27 of the side walls. The free end portion of the stab has been cut away as at 38 to facilitate alignment. The inside wall of channel 27 is also cut away adjacent each end of the side walls to permit the laterally extending channel 32 to sit flush with the top and bottom of the cabinet as illustrated in FIG. 3 when the stabs of the rigidifying bars are firmly in place.

FIG. 2 generally illustrates the direction of insertion of the stabs of the rigidifying bars into the channels of the side walls and FIG. 3 illustrates the side walls and rigidifying bars finally in place.

Thus, the initial steps of installation as indicated in FIG. 2 consist of sliding the side walls into contcat with the back wall and inserting the stabs of the rigidifying cross bars into the channels of the side walls wherein they are a snug telescoping fit.

The top wall 12 has downwardly depending flanges that are adapted to overhang the vertical walls of the cupboard at the upper marginal portions. The sides of the top wall are slipped over the end of the body as indicated in FIGS. 3, 5 and 6. It will be noted that the front flange of the top wall 12 has an inwardly directed locking flange 39 along its front edge. This locking flange snaps over the lower edge of the rigidifying bar 30 to maintain the top wall in assembled position with respect to the body.

It will also be noted that the back wall of the top 12 has a seam 40 on its downwardly flange. The upper edge of the back wall 16 also has a seam as at 42 along its edge for cooperation with the seam 40. FIGS. 3 and 5 show the initial stages of placement of the top wall. As the top wall is rotated in the direction of the arrow the flange 39 snaps over the bar 30 as in FIG. 6.

After the top wall 12 has been snapped into position as described, the back wall 16 is slid towards the top wall as indicated in FIG. 5. In this position the open edges of th seams 40 and 42 are facing each other. The back wall 16 is then slid downwardly to cause the seams 40 and 42 to interlock with each other. This achieves a securement of the back wall to the top wall along their respective meeting edges.

It will be noted that the bottom edges of the side wall 18, back wall 16 and side wall 20 are each formed with an internally directed channel. These channels are adapted to receive the downwardly directed flanges 44, 46 and 48 respectively of the bottom wall 14. Downwardly directed flanges 44, 46 and 48 have an in-turned edge and are a comfortable fit within their respective channels on the side walls to achieve a good rigidifying function.

The front wall of the bottom 14 is formed with an internally directed locking flange 50 that springs over the lower eege of the bottom rigidifying bar 30 as the bottom wall is pressed into position. The bottom wall is pressed into position from the inside of the cabinet as illustrated in FIG. 3.

Figure 1:
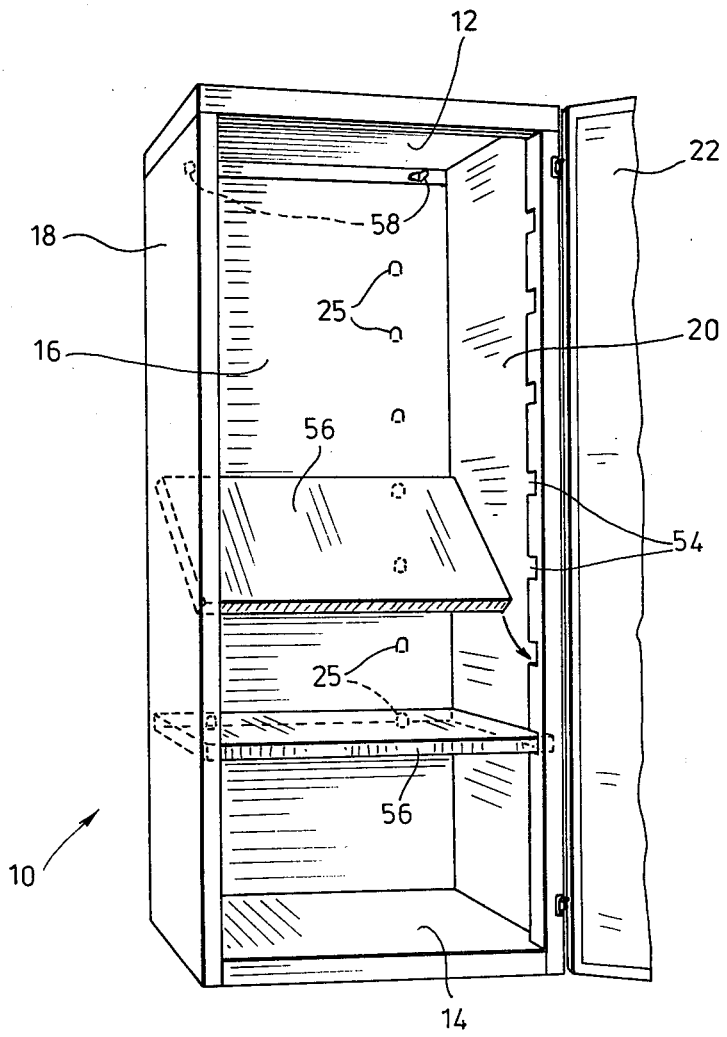
FIG. 1 is an illustration of a cupboard in set-up position.

All parts are made from a sheet metal which has a certain amount of resilience to permit the springing action of the flanges and the unit, when assembled as illustrated in FIG. 1, is rigid. The various flanges that fit within each other are a comfortable fit that provides a support to maintain the cupboard erect and square.

The door is simply attached by means of a simple hinge that has previously been assembled to the door and the edge of side wall 20.

The channels down the front edges of the side walls are notched as at 54 to receive the front edge of shelving units 56 which are inserted from the top as indicated in FIG. 1 and rotated rearwardly to sit on the lugs 25 in the back wall.

The back wall 16 is locked against displacement by manipulation of the lugs 58 in an inward direction to engage with the upper edge of the U-shaped formation 42 on the back wall 16 whereby to prevent it from disengagement with the cooperative seam 40 of the top wall as illustrated in FIG. 6.

The basic structure of the unit is not new. For example, units of this general type and having cross support bars like the support bars 30 but which are held together by bolts are old. The novelty in this invention is the construction of the parts so that they can be slid and pushed together in a way that they will maintain their erect position without the need of any bolts. It is the combination of features that contribute to the boltless construction and the features that are new and thought to contribute to the end result. The sliding cooperation of the side walls and back wall at their longitudinal edges, the spring securement of the top wall and bottom wall with the side walls through the expedient of the spring flanges 39 and 50 and the interlocking of the top wall to the back wall along its upper edge by displaceable lugs 58. These features combine to eliminate the requirement for bolts in assemblies of this kind.

Embodiments of the invention other than the specific one illustrated will be apparent to those skilled in the art and it is not the intention that the invention should be limited by the specific embodiment illustrated.

The embodiments of the invention in which an exlcusive property or privilege is claimed are defined as follows:

1. A boltless sheet metal cupboard or cabinet assembly having:
- a top wall;
- a bottom wall;
- a back wall;
- and opposed side walls;
- a flange on the back longitudinal edge of each side wall, a hem on the edge of each flange that forms a U-configuration with its open end facing its respective side wall;
- a hem on each of the side edges of said back wall that forms a U-configuration with its open end facing the open end of the hem on the other side edge, the hems on the back wall and the hems of the side walls being adapted to interlock with each other;
- an open front;
- a door hingeable to close the open front;
- the front longitudinal edge of each side wall being formed with a channel;
- a rigidifying top bar having a stab connector at each of its ends for entry into the channel of one of the side walls whereby to extend between the side walls at the top front and space them apart in operative position in use;

a rigidifying bottom bar having a stab connector at each of its ends for entry into the channel of one of said side walls whereby to extend between the side walls at the bottom front and space them apart in operative position in use;

the top wall having downwardly extending flanges along each of its edges;

the downwardly extending flange along the front edge of the top wall having an inwardly projecting locking flange at its lower edge adapted to snap over the lower marginal edge portion of the edge of the rigidifying top bar;

the downwardly extending flange along the back edge of the top wall having a hem that forms a U-configuration with its open end facing upwardly;

the upper edge of the back wall having an outwardly directed hem that forms a U-configuration with its open end facing downwardly that is adapted to interlock with the hem on the flange on the back edge of the top wall;

each of the back wall and side walls having an inwardly directed channel at their lower edges;

the bottom wall having an L-shaped flange along its back and side edges adapted to drop into said channels on the lower edges of the back and side walls with a slide fit;

the bottom wall having a downwardly extending L-shaped flange at its front edge to embrace the front face and the marginal area near the front face of the bottom surface of the bottom rigidifying bar in use, said downwardly extending flange of said top wall at its back edge being formed with lug means, said lug means being depressable with respect to the plane of the flange to limit movement of the upper edge of the back wall with respect to the side walls in use.

2. A boltless sheet metal cupboard or cabinet assembly having:

a top wall;

a bottom wall;

a back wall;

and opposed side walls;

the back wall and the side walls being formed along their adjoining edges to telescope together in a direction longitudinally of their edges;

a rigidifying top bar to extend between the side walls at their upper extremities, said top bar and said side walls being formed to telescope together;

a rigidifying bottom bar to extend between the side walls at their lower extremities, said bottom bar and said side walls being formed to telescope together;

said top wall having downwardly extending front and rear flanges, said front flange adapted to overlie the front face of said top rigidifying bar and an inwardly projecting locking flange at the lower edge of said front flange adapted to engage the marginal area of the underside of said top rigidifying bars in use;

said bottom wall having a downwardly extending front flange adapted to overlie the front face of said bottom rigidifying bar and an inwardly projecting locking flange at the lower edge of said front flange adapted to engage the marginal area of the underside of said bottom rigidifying bar in use;

the side walls and back wall being formed along their adjoining edges to the bottom wall with a channel adapted to receive the adjoining edge of the bottom wall in nesting relation, said top wall having a back flange adapted to overlay the marginal portion of said back wall, said back flange being formed with lug means, said lug means being depressable with respect to the plane of the flange to limit the movement of the upper edge of the back wall with respect to the side walls in use.

* * * * *